US009399930B2

(12) United States Patent
Bannister et al.

(10) Patent No.: US 9,399,930 B2
(45) Date of Patent: Jul. 26, 2016

(54) ORC HEAT ENGINE

(71) Applicant: ENERGETIX GENLEC LIMITED, Chester (GB)

(72) Inventors: John Joseph Bannister, Glossop (GB); Timothy Nathan Bannister, Glossop (GB); Neil Stafford Bright, Stratford upon Avon (GB); Iain James Henshaw, Manchester (GB)

(73) Assignee: Energetix Genlec Limited, Chester (GB)

( * ) Notice: Subject to any disclaimer, the term of this patent is extended or adjusted under 35 U.S.C. 154(b) by 240 days.

(21) Appl. No.: 14/345,306

(22) PCT Filed: Sep. 19, 2012

(86) PCT No.: PCT/GB2012/052311

§ 371 (c)(1),
(2) Date: Mar. 17, 2014

(87) PCT Pub. No.: WO2013/041857

PCT Pub. Date: Mar. 28, 2013

(65) Prior Publication Data

US 2014/0298812 A1 Oct. 9, 2014

(30) Foreign Application Priority Data

Sep. 19, 2011 (GB) ..... 1116158.5

(51) Int. Cl.

| | |
|---|---|
| ***F01K 13/02*** | (2006.01) |
| ***F01K 25/08*** | (2006.01) |
| ***F01K 13/00*** | (2006.01) |
| ***F01C 20/06*** | (2006.01) |
| *F01C 1/02* | (2006.01) |

(52) U.S. Cl.

CPC ..... *F01K 13/00* (2013.01); *F01C 20/06* (2013.01); *F01K 13/02* (2013.01); *F01K 25/08* (2013.01); *F01C 1/0207* (2013.01); *F04C 2240/403* (2013.01)

(58) Field of Classification Search

CPC ..... F01K 13/00; F01K 25/08; F01K 13/02; F01C 20/06; F01C 1/0207; F04C 2240/403

USPC ..... 60/651, 671, 660

See application file for complete search history.

(56) References Cited

U.S. PATENT DOCUMENTS

| | | | | |
|---|---|---|---|---|
| 8,627,663 | B2 * | 1/2014 | Ernst | F01K 9/003 60/616 |
| 8,813,498 | B2 * | 8/2014 | Kopecek | F01K 25/10 415/1 |
| 2002/0108372 | A1 * | 8/2002 | Bronicki | F01K 13/02 60/651 |
| 2003/0015873 | A1 | 1/2003 | Khalizadeh et al. | |

(Continued)

FOREIGN PATENT DOCUMENTS

EP 2014880 A1 1/2009

OTHER PUBLICATIONS

International Searching Authority, International Preliminary Report of Patentability, Apr. 29, 2014, 7 pages.

*Primary Examiner* — Hoang Nguyen

(74) *Attorney, Agent, or Firm* — Taft Stettinius & Hollister, LLP; Stephen F. Rost

(57) ABSTRACT

An ORC heat engine including a working fluid circuit having an evaporator for heating and evaporating a working fluid, a condenser for cooling and condensing the working fluid, and a positive displacement expander-generator having an inlet in fluid communication with the evaporator and an outlet in fluid communication with the condenser. The ORC heat engine further includes a control system coupled to the positive displacement expander-generator having a switch and driving means, the switch being switchable between a first state and a second state, wherein in the first state the switch is coupled to the driving means, and the positive displacement expander-generator is drivable by the driving means, and in the second state the switch is not coupled to the driving means or the driving means is switched off, and the positive displacement expander-generator is not drivable by the driving means.

22 Claims, 3 Drawing Sheets

(56) References Cited

U.S. PATENT DOCUMENTS

2003/0213245 A1* 11/2003 Yates ..... F01K 17/02 60/651
2004/0055303 A1* 3/2004 Sugarmen ..... F01K 3/247 60/670
2006/0213218 A1 9/2006 Uno et al.
2009/0071156 A1 3/2009 Nishikawa et al.

* cited by examiner

ORC HEAT ENGINE

This application is a U.S. national stage application under 35 U.S.C. § 371 of PCT International Application Ser. No. PCT/GB2012/052311, which has an international filing date of Sep. 19, 2012, designates the United States of America, and claims the benefit of GB Application No. 1116158.5, which was filed on Sep. 19, 2011. The disclosures of each of these prior applications are hereby expressly incorporated by reference in their entirety.

This invention relates to an ORC heat engine and, more specifically, to an improved ORC heat engine having a control system for controlling the ORC heat engine.

BACKGROUND

Heat engines, such as combined heat and power (CHP) appliances that are based on an organic Rankine cycle (ORC) module, are known. Heat engines of this kind employ a positive displacement device, such as a scroll-expander, connected to a generator, such as a permanent magnet generator, in a single unit. Such CHP appliances may replace conventional gas boilers to provide heat for central heating and hot water, with electricity produced as a by-product.

An example of a simple known ORC 10 heat engine is shown schematically in FIG. 1A. The ORC has a working fluid circuit 12 that includes an evaporator 14 acting as a heat source for heating a working fluid circulating around the working fluid circuit 12, a positive displacement expander-generator 16, a condenser heat exchanger 18 acting as a heat sink for cooling the working fluid and a pump 20. Each of evaporator heat exchanger 14, expander-generator 16, condenser 18 and pump 20 are fluidly connected in series in the working fluid circuit 12. The expander-generator 16 has an inlet in fluid communication with the evaporator 14, and an outlet in fluid communication with the condenser 16. The pump 20 is disposed in the working fluid circuit 12 between the condenser 18 and the evaporator 14 but on the opposite side of the condenser 18 to the expander-generator 16.

In steady state operation, the working fluid is evaporated in the evaporator 14 at high pressure (pressure P1) and temperature T1. The evaporator 14 receives an input of heat $Q_{in}$ and does work $W_{in}$ to raise the temperature of the working fluid to temperature T1. The evaporated gas phase fluid is then expanded through the expander-generator 16 thus producing electrical energy, $W_e$. The gas exits the expander-generator 16 at a lower pressure P2 and temperature T2 and is then condensed back to the liquid phase in the condenser 18 where the latent heat of condensation is given up to a cooling circuit (not shown). The condenser 18 receives a coolant so as to remove energy $W_{out}$ and heat $Q_{out}$ from the working fluid. The low temperature T2' and low pressure P2 liquid phase working fluid is then pumped back to the evaporator at high pressure P1 by the pump 20, thus completing the cycle.

Upon starting the ORC heat engine 10 of FIG. 1A, heating $Q_{in}$ and cooling $Q_{out}$ is supplied to the evaporator 14 and condenser 18, respectively, and the pump 20 is operated to provide the high pressure P1 and flow of working fluid into the evaporator 14. Initially, the expander-generator 16 is not rotating so there is no flow of working fluid around the working fluid circuit 12. The expander-generator 16 does not begin to rotate when the pump 20 begins to run due to seal and bearing friction together with the mass of the generator parts. Additionally, a negative pressure differential begins to form across the expander-generator 16 as the expander tries to expand pockets of gas that have equalised with the low pressure working fluid when at rest.

To overcome this initial "stiction", a large initial inlet pressure is required to start the rotation. This initially high starting pressure is supplied by the pump 20. However, since the expander-generator 16 is not rotating initially, there is very little working fluid flowing through the pump 20. This situation is detrimental to the lifetime and performance of the pump 20 since the pump 20 can overheat and lubrication therein can be reduced.

Another undesirable situation that may arise at start-up is the pump 20 beginning to run dry. This might happen where the non-rotating expander-generator 16 acts as a blockage along the working fluid circuit 12 and the pump 20 works to displace working fluid towards the evaporator 14. Without sufficient circulation of working fluid, the entire volume of working fluid could be pumped into the evaporator 14, causing the pump 20 to run dry, thereby increasing pump wear and reducing its lifetime.

In order to successfully replace a conventional gas boiler from the operator's perspective, an ORC heat engine, such as a CHP appliance, should be able to operate across a range of temperatures and heat demands, and should be able to be turned on and off in the same manner as a conventional gas boiler system.

It is an object of the present invention to provide an ORC heat engine that improves over prior art ORC heat engines, by having, for example, an improved start-up time, improved component lifetime and performance, or increased operational efficiencies.

BRIEF SUMMARY OF THE DISCLOSURE

In accordance with a first aspect of the present invention, there is provided an organic Rankine cycle (ORC) heat engine. The OCR heat engine includes a working fluid circuit having an evaporator for heating and evaporating a working fluid, a condenser for cooling and condensing the working fluid, and a positive displacement expander-generator having an inlet in fluid communication with the evaporator and an outlet in fluid communication with the condenser. The ORC heat engine further includes a control system coupled to the positive displacement expander-generator having a switch and driving means, wherein the switch is switchable between a first state and a second state. In the first state the switch is coupled to the driving means, and the positive displacement expander-generator is drivable by the driving means. In the second state the switch is not coupled to the driving means or the driving means is switched off, and the positive displacement expander-generator is not drivable by the driving means.

Preferably, the working fluid circuit further comprises a pump for increasing the pressure of working fluid circulating around the working fluid circuit. Additionally or alternatively, the control system preferably further comprises sensing means for sensing an operating condition of the ORC heat engine.

The control system preferably further comprises processing means for switching the switch between the first and second states in response to an input. In a particularly preferable embodiment, the processing means is coupled to the sensing means and the processing means is configured to switch the switch between the first and second states when a predetermined operating condition is met.

Preferably, the sensing means includes a first sensing means and a second sensing means wherein the first sensing means is configured to sense the rotational speed of the positive displacement expander-generator and adjust the output of the driving means such that a substantially fixed rotational speed of the expander-generator is maintained when the switch is in the first state, and wherein the second sensing means is configured to sense an operating parameter of the driving means.

Preferably, the predetermined operating condition is met when the output of the driving means is less than or equal to a predetermined threshold.

In one preferably embodiment, the positive displacement expander-generator comprises an expander and a generator each on a common shaft and the pump is coupled to the expander-generator on the common shaft. In one particular preferable embodiment, the pump is arranged between the expander and the generator.

The switch comprises an electromechanical switch, and preferably comprises an electromechanical three-pole change-over switch (3PCO). In an alternative embodiment, the switch preferably comprises one or more solid state relays or a semiconductor switch.

The expander-generator preferably comprises a scroll expander, and preferably comprises a permanent magnet generator. The driving means preferably comprises a motor and the switch includes a clutch for connecting and disconnecting motor from the expander-generator, where, preferably, the driving means comprises an inverter. The inverter is preferably configured to take power from a direct current bus and supply a 3-phase electrical current to the positive displacement expander-generator in order to drive the positive displacement expander-generator. Additionally or alternatively, the inverter is switchable to act as a rectifier so that, when the positive displacement expander-generator is generating a 3-phase electrical current, the inverter acts as a rectifier to convert the 3-phase electrical current produced to a direct current (DC) for supply to a DC bus. In this preferable embodiment, the switching of the inverter occurs automatically when the displacement expander-generator begins to generate a current, reversing the direction of the current.

Preferably, the first sensing means is configured to adjust the output of the inverter by adjusting the electrical current supplied to the inverter, and wherein the operating parameter of the inverter sensed by the second sensing means is the electrical current being supplied to the inverter.

In one embodiment, the predetermined operating condition is preferably met when the electrical current being supplied to the inverter is less than or equal to a predetermined threshold, which is preferably about 0 A.

Preferably ORC heat engine of the present invention further comprises a regenerator heat exchanger arranged to facilitate the exchange of heat between working fluid exiting the outlet of the positive displacement expander-generator and the working fluid entering the evaporator.

In accordance with a second aspect of the present invention, there is provided an electrical system comprising an ORC heat engine according to the first aspect of the present invention, and an electrical load arranged to be electrically coupled to the expander-generator when the switch is in the second state such that the electrical load can be powered by electrical power produced by the expander-generator.

In accordance with a third aspect of the present invention, there is provided a control system for controlling an ORC heat engine. The control system includes an inverter, a switch being switchable between a first state and a second state, sensing means coupled to the switch and configured to sense an operating condition of the ORC heat engine, and processing means coupled to the sensing means, the processing means being configured to switch the switch between the first and second states when a predetermined operating condition is met. In the first state, the switch is electrically coupled to the inverter and in the second state, the switch is not electrically coupled to the inverter, such that when the control system is connected to a heat engine that includes a positive displacement expander-generator, the positive displacement expander-generator is drivable by the inverter when the switch is in the first state, and the positive displacement expander-generator is not drivable by the inverter when the switch is in the second state.

In accordance with a fourth aspect of the present invention, there is provided a method of controlling an ORC heat engine. The method includes the steps of:

(i) providing an ORC heat engine according to the first aspect of the present invention with the switch in the first state;

(ii) operating the driving means to drive the positive displacement expander-generator and thereby circulate working fluid around the working fluid circuit;

(iii) switching the switch from the first state to the second state so that the expander-generator is driven by the circulating working fluid and not the driving means, and generates electrical power.

In a preferable embodiment, the working fluid circuit of the ORC heat engine further includes a pump for increasing the pressure of working fluid circulating around the working fluid circuit, and wherein the method further includes the step of: (iv) operating the pump to increase the pressure of the circulating working fluid, prior to step (iii).

Further preferably, the positive displacement expander-generator of the ORC heat engine includes an expander and a generator each on a common shaft and the pump is coupled to the expander-generator on the common shaft, and wherein step (iv) is performed simultaneously with step (ii). The control system of the ORC heat engine preferably further includes sensing means for sensing an operating condition of the heat engine, and processing means coupled to the sensing means wherein the processing means automatically executes step (iii) when a predetermined operating condition is met. In one preferable embodiment, the pump is arranged between the expander and the generator, although this need not necessarily be the case in other embodiments.

Further preferably, the sensing means includes a first sensing means and a second sensing means, wherein the first sensing means senses the rotational speed of the positive displacement expander-generator and adjusts the output of the driving means such that a substantially fixed rotational speed of the expander-generator is maintained when the switch is in the first state, and the second sensing means senses an operating parameter of the driving means; and wherein the predetermined operating condition is met when the output of the driving means is less than or equal to a predetermined threshold.

In an alternative embodiment, the sensing means preferably senses a pressure lift in the working fluid produced by the pump, and the predetermined operating condition is met when the sensed pressure lift is greater than or equal to a predetermined threshold.

In any embodiment, the method preferably further comprises the step of connecting the expander-generator to an electrical load via the switch prior to executing step (iii), wherein subsequent to step (iii) electrical power generated by the expander-generator is supplied to the electrical load via the switch. The driving means preferably comprises an inverter.

BRIEF DESCRIPTION OF THE DRAWINGS

Embodiments of the invention are further described hereinafter with reference to the accompanying drawings; in which.

DETAILED DESCRIPTION

Figure 1A:
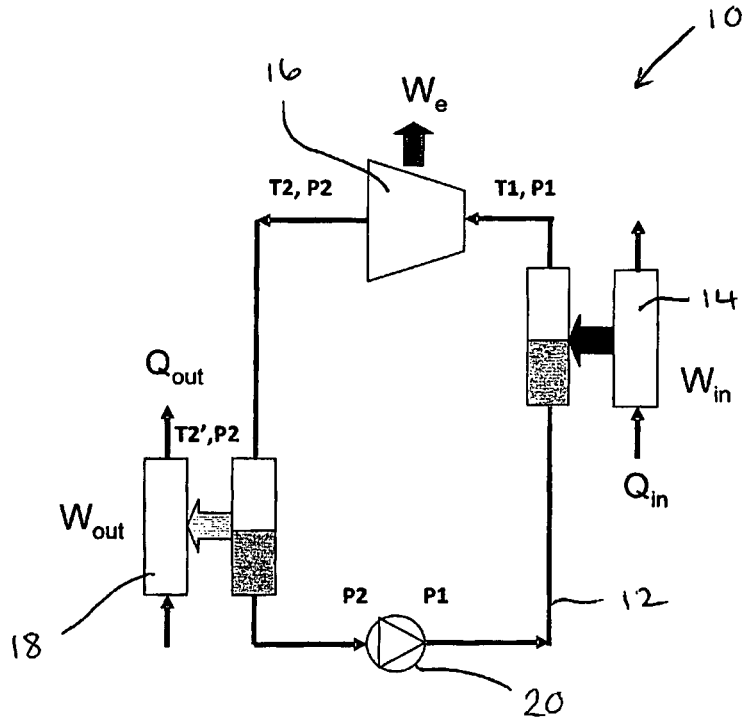
FIGURE 1A (PRIOR ART)
FIG. 1A schematically shows a known organic Rankine cycle (ORC) heat engine, and FIG. 1B schematically shows a similar ORC heat engine that includes a regenerator heat exchanger.
Figure 2:
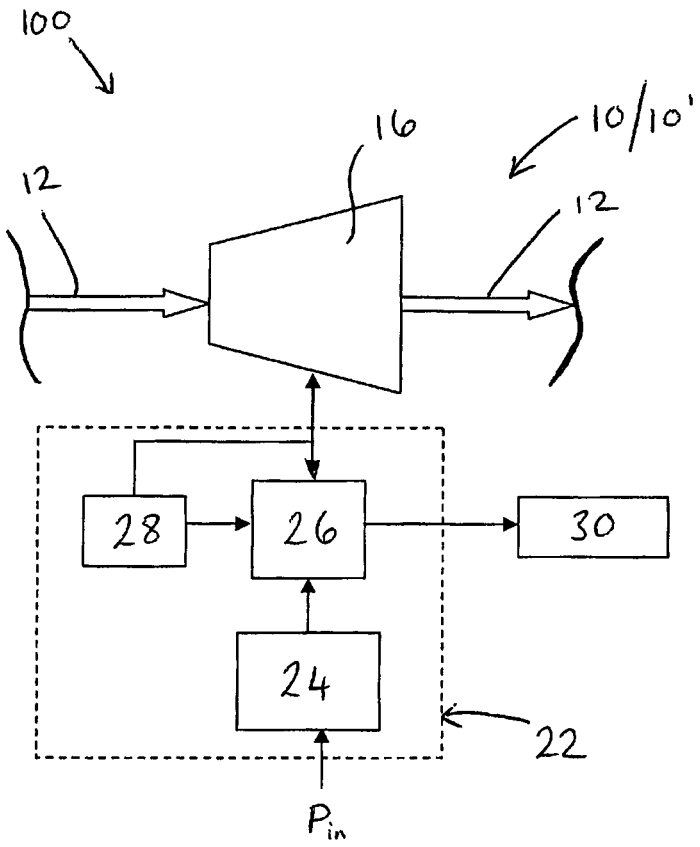
FIG. 2 shows an ORC heat engine according to an embodiment of the present invention comprising a control system and a connected load.

FIG. 1A schematically shows a known organic Rankine cycle (ORC) 10 which forms the basic components of a heat engine. An electrical system according to an embodiment of the present invention is shown schematically in FIG. 2 which comprises a heat engine 100 having an ORC system 10 (shown partially only) and a control system 22, and a connected electrical load 30. The ORC system 10 of the present invention is substantially identical to the ORC system 10 of FIG. 1A and comprises the same components, namely a working fluid circuit 12 that includes an evaporator 14 acting as a heat source for heating a working fluid circulating around the working fluid circuit 12, a positive displacement expander-generator 16, a condenser heat exchanger 18 acting as a heat sink for cooling the working fluid and a pump 20.

Figure 1B:
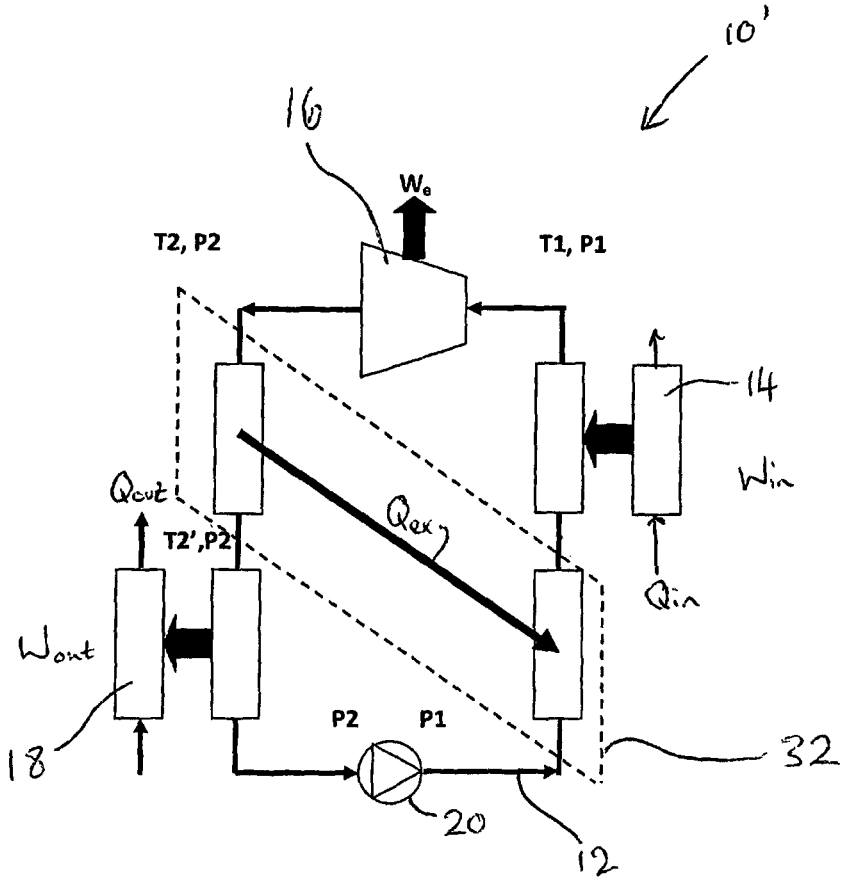
FIGURE 1B (PRIOR ART)

FIG. 1B shows a modified ORC 10' that may be used as part of the present invention. The modified ORC 10' includes a regenerator heat exchanger 32. The regenerator heat exchanger 32 is an additional heat exchanger in the system that helps boost system performance. Under ideal conditions, a regenerator heat exchanger 32 would not be necessary, however, in real systems it is often not possible to match the thermodynamic properties of working fluids to the exact pressures and temperatures encountered in the ORC 10' at specific points. For example, in a real system, the working fluid exiting the positive displacement expander-generator 16, once expanded, is still in a superheated state. Conversely, in an ideal system, the working fluid would be only slightly superheated, or even a saturated vapour. The regenerator 32 takes some of the excess heat present in real world systems and transfers it ($Q_{ex}$) to the working fluid on the opposite side of the cycle prior to its entry into the evaporator 14. In providing this corrective measure, the regenerator 32 enables the system 10' to be tuned to an optimum efficiency by compensating for the slight mismatch between a selected working fluid and an idealised working fluid. The regenerator 32 therefore reduces the heat to power ratio of system 10' which is advantageous to a micro combined heat and power product.

The control system 22 comprises an inverter 24, a switch 26 and sensing means 28. The control system 22 is coupled to the positive displacement expander-generator 16 of the ORC 10/10'. The switch 26 is switchable between a first state and a second state. In the first state, the switch 26 is electrically coupled to the inverter 24 and the positive displacement expander-generator 16 is drivable by the inverter when electrical power $P_{in}$ is supplied to the inverter. In the second state, the switch 26 is not electrically coupled to the inverter 24, and the positive displacement expander-generator 16 is not drivable by the inverter. In the second state, however, the switch 26 electrically couples the electrical load 30 to the expander-generator 16 such that electrical power generated by the expander-generator 16 can power the electrical load 30.

Although the present invention is described as having an inverter as part of the control system for selectively driving the expander-generator, alternative embodiments may employ any suitable driving means, such as a motor, for selectively driving the expander-generator, where the switch determines whether the driving means is able to drive the expander-generator or not.

It is also known that an inverter may be employed as a rectifier in some systems. Some inverters include 'free-wheel' diodes across the switching transistors, commonly IGBT type semiconductors, that allow the driven machine to free-wheel. When the driven machine is generating power it is known that the free-wheel diodes maybe used to rectify the AC electrical power from the machine and convert it to a DC electrical power. Such systems as described include a DC rail that feeds a grid connected inverter in order to output the electrical power generated in a CHP system to the mains electrical supply in a domestic dwelling. In such a fashion it is possible to drive the scroll using an inverter and use the same inverter to rectify the three phase alternating power output from the expander-generator to DC once it is generating ready to be inverted and fed in to a single phase mains supply.

The sensing means 28 are capable of sensing one or more operating conditions of the heat engine 100. In one embodiment, the control system 22 further comprises processing means (not shown) for switching the switch 26 between the first and second states in response to an input. The input may be a user input or an automatic input, such as an input from the sensing means 28, for example. In a preferable embodiment, the processing means are arranged to switch the switch 26 when a predetermined operating condition, as sensed by the sensing means 28, is met. In a further preferable embodiment, the sensing means 28 comprises a first sensing means and a second sensing means, where the first sensing means is configured to sense the rotational speed of the positive displacement expander-generator 16 and adjust the electrical current supplied to the inverter 24 such that a fixed rotational speed is maintained when the switch 26 is in the first state. The second sensing means is configured to sense the electrical current being supplied to the inverter. When the electrical current being supplied to the inverter 24 is sensed by the second sensing means to be less than or equal to a predetermined threshold (e.g. about 0 A), the predetermined operating condition is met and the processor switches the switch 26 between the first and second states.

At system start-up, the expander-generator 16 is connected to the inverter 24 by the switch 26. Initially, the inverter 24 drives the expander-generator 16 at a relatively slow (around 800 rpm, for example) but fixed rotational speed, as compared to the operational speed of the expander-generator 16 (e.g. 3600 rpm). When the expander-generator 16 is rotating, it does not act as a closed valve within the working fluid circuit 12 and the thermodynamic working fluid can circulate around the circuit 12. At start-up, this driven arrangement allows heat from the evaporator 14 to pass around the ORC system 10/10' heating it up more quickly than would be the case if the expander-generator 16 was not rotating, or if the ORC system 10/10' was heated though the condenser 18 by a lower temperature preheat circuit. Also this process rapidly heats areas of the ORC system 10/10' that are hot in an operational running state rather than heating the condenser 18, which is colder in its operational running state. Therefore, the operational running state conditions of the ORC system 10/10' are achieved faster.

Once the ORC system 10/10' has been heated sufficiently, or once a set degree of sub-cooling is achieved, the pump 20 can be turned on to increase the pressure of the working fluid and provide a pressure lift, thus raising the pressure at the inlet of the expander-generator 16. When there is little flow around the working fluid circuit 12, the rotating expander-generator 16 acts as a displacement pump which effectively feeds the pump 20 with working fluid. This prevents the pump 20 running dry, thereby minimising pump wear and increasing pump lifetime.

When working fluid flow begins to drive the expander-generator 16, the inverter 24 will be required to deliver less torque to maintain the fixed rotational speed. In order to maintain a substantially fixed speed, the first sensing means senses the rotational speed of the expander-generator 16 and adjusts the electrical current supplied to the inverter 24 if the rotational speed is slightly above or below the desired rotational speed. This feedback adjustment of the current supplied to the inverter 24 allows the rotational speed of the expander-generator to be substantially maintained at a desired level.

As the expander-generator 16 begins to be increasingly driven by the circulating working fluid rather than the inverter 24, the current from the inverter 24 begins to fall. At the point where the expander-generator 16 is being driven substantially by the working fluid (which is driven by the pump 20), the current supplied to the inverter 24 will fall to zero or to a low level. A predetermined operating condition, such as the inverter current equaling or falling below a predetermined threshold such as 0 A, for example, can determine a "critical switching point" for the system, whereby the switch 26 is switched from the first state to the second state. The switching of the switch 26 may be actuated by the processor means when the predetermined operating condition is met. In alternative embodiments, predetermined operating conditions other than the inverter current may determine the critical switching point. For example, amongst other possible parameters, a predetermined operating condition relating to inverter torque or inverter voltage can be used to determine the critical switching point. In other embodiments, the predetermined operating condition might relate to elapsed time since system start up.

As the switch 26 is switched from the first to the second state, the expander-generator 16 is rapidly disconnected from the inverter 24 and connected to the load 30. If a suitable switch-over point (i.e. predetermined condition) has been chosen, the expander-generator 16 will continue to rotate due to the circulating working fluid and will produce electrical power $W_e$ which is delivered to the load 30 via the switch 26. It is important to switch over the expander-generator 16 at the point where the thermodynamic flow through the expander-generator 16 is sufficient to keep it rotating once the expander-generator 16 is disconnected from the inverter 24 and is connected to the load 30. Once the switch-over has occurred, the expander-generator 16 can be accelerated to its optimum working speed.

A particularly preferable and reproducible method of critical switching is to use a predetermined operating condition that relates to the pressure difference generated by the pump 20. When the pump 20 is first switched on at low speed, it begins to produce a pressure lift. As the pump speed is increased the pressure lift also increases. There is a minimum pressure lift which is such that if the inverter is switched off or disconnected from the expander-generator 16, the expander-generator 16 will continue to rotate due to the pressure lift produced by the pump 20. This minimum pressure represents the earliest critical switching point. If the inverter 24 is switched off or disconnected from the expander-generator 16 when the pressure of the working fluid is at or above the minimum pressure, the expander-generator 16 will continue to rotate due to the circulation of the working fluid.

The switch 26, itself, may be an electromechanical three-pole change-over (3PCO) switch, a solid state relay switch, a semiconductor switch, or any other suitable switch or combination of switches that allows the expander-generator 16 to be selectively connected to the inverter 24 and the load 30.

In an alternative embodiment of the invention, the expander and generator of the expander-generator 16 are coupled to one another on a common shaft and the pump 20 is coupled to the expander-generator 16 on the same common shaft such that the pump 20 is arranged between the expander and the generator. The expander-generator 16 and the pump 20 are preferably thermally isolated from one another, preferably by a magnetic coupling.

In this alternative embodiment, the inverter 24 can be used to drive the expander-generator 16 on start-up before a pressure head is generated. Due to the coupling of the expander-generator 16 and the pump 20, the rotating expander-generator 16 causes the pump 20 to also rotate and operate, and thus causes the working fluid to circulate around the working fluid circuit at a rate proportional to the speed of rotation of the expander-generator 16 and the pump 20.

As the working fluid pressure rises to the minimum level at which the driving force delivered to the expander-generator 16 by the inverter 24 is not required to maintain rotation of the expander-generator 16, the current requirement of the inverter 24 drops to zero and the inverter 24 can be switched off or disconnected from the expander-generator as the working fluid pressure generated in the evaporator 14 is sufficient to cause the expander-generator 16 to continue to rotate and, in turn, drive the pump 20.

As with the first embodiment described above, sensing means may be used as part of a feedback system for reducing the current supplied to the inverter 24 as the inverter 24 is required less to maintain rotation of the expander-generator 16 at a substantially constant speed, and processing means may be used to switch the switch 26 so that the expander-generator 16 is disconnected from the inverter 24 (or the inverter 24 is switched off) and is connected to the electrical load 30 when the predetermined condition is met. The processing means may operate on the basis of a control algorithm which considers parameters measured by the sensing means.

In any embodiment, the present invention has the advantage of providing a start-up routine that ensures that the working fluid pump 20 is not operated in unfavourable situations that are detrimental to pump lifetime and performance. Consequently, less lubricant is required in the working fluid thereby increasing system efficiency and, in particular, electrical efficiency. The start-up time of a heat engine in accordance with the present invention is substantially reduced compared to prior art arrangements. For example, a heat engine made in accordance with the present invention is capable of operating at approximately 90% of its full power capability within 3 minutes from start-up (from cold). When using a pre-heating procedure only, a typical prior art heat engine will take over 10 minutes to reach the same operating level. Pre-heating the engine prior to operation has the benefit that once operation is commenced the evaporated working fluid does then not condense on contact with cold engine components and fail to permeate through to the low pressure side of the ORC system 10/10'. This prevents the pump 20 being starved of fluid on the suction side which may occur if heated gaseous working fluid is fed into a cold stationery engine. The skilled person will appreciate that preheating can be readily achieved by electrical heating on the engine though a number of suitable alternative methods.

The present invention requires fewer mechanical components as compared to heat engines using pre-heating procedures, and so the overall cost of a system according to the present invention is less, and reliability is increased. The present invention negates the previous requirement of a start pressure provided by the working fluid pump 20, therefore reducing the operational wear, improving operational performance, and increasing the longevity of the pump 20. Additionally, by having a switching point that is determined by a predetermined operating condition, there is more certainty in knowing when power generation by the expander-generator 16 will begin. Furthermore, the present invention allows for a simplified start-up protocol, given that there is no distinction needed between a "cold-start" where the system has not recently been running, and a "hot-restart" where the system is restarted.

Throughout the description and claims of this specification, the words "comprise" and "contain" and variations of them mean "including but not limited to", and they are not intended to (and do not) exclude other moieties, additives, components, integers or steps. Throughout the description and claims of this specification, the singular encompasses the plural unless the context otherwise requires. In particular, where the indefinite article is used, the specification is to be understood as contemplating plurality as well as singularity, unless the context requires otherwise.

Features, integers, characteristics, compounds, chemical moieties or groups described in conjunction with a particular aspect, embodiment or example of the invention are to be understood to be applicable to any other aspect, embodiment or example described herein unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The invention is not restricted to the details of any foregoing embodiments. The invention extends to any novel one, or any novel combination, of the features disclosed in this specification (including any accompanying claims, abstract and drawings), or to any novel one, or any novel combination, of the steps of any method or process so disclosed.

The reader's attention is directed to all papers and documents which are filed concurrently with or previous to this specification in connection with this application and which are open to public inspection with this specification, and the contents of all such papers and documents are incorporated herein by reference.

The invention claimed is:

1. An organic Rankine cycle (ORC) heat engine comprising:

a working fluid circuit comprising:

an evaporator for heating and evaporating a working fluid;

a condenser for cooling and condensing the working fluid; and a positive displacement expander-generator having an inlet in fluid communication with the evaporator and an outlet in fluid communication with the condenser; the ORC heat engine further comprising:

a control system coupled to the positive displacement expander-generator comprising a switch and driving means, the switch being switchable between a first state and a second state, wherein in the first state the switch is coupled to the driving means, and the positive displacement expander-generator is drivable by the driving means, and in the second state the switch is not coupled to the driving means or the driving means is switched off, and the positive displacement expander-generator is not drivable by the driving means; wherein the control system further comprises sensing means for sensing an operating condition of the ORC heat engine and processing means for switching the switch between the first and second states in response to an input, the processing means being coupled to the sensing means and the processing means being configured to switch the switch between the first and second states when a predetermined operating condition is met; and wherein the predetermined operating condition is the thermodynamic flow through the positive displacement expander-generator being sufficient to keep the positive displacement expander-generator rotating once the positive displacement expander-generator is disconnected from the driving means and connected to an electrical load.

2. The ORC heat engine according to claim 1, wherein the working fluid circuit further comprises a pump for increasing the pressure of working fluid circulating around the working fluid circuit.

3. The ORC heat engine according to claim 2, wherein the sensing means comprises a first sensing means and a second sensing means, wherein the first sensing means is configured to sense the rotational speed of the positive displacement expander-generator and adjust the output of the driving means such that a substantially fixed rotational speed of the expander-generator is maintained when the switch is in the first state, and wherein the second sensing means is configured to sense an operating parameter of the driving means.

4. The ORC heat engine according to claim 3, wherein the predetermined operating condition is met when the output of the driving means is less than or equal to a predetermined threshold.

5. The ORC heat engine according to claim 4, wherein the positive displacement expander-generator comprises an expander and a generator each on a common shaft and the pump is coupled to the expander-generator on the common shaft.

6. The ORC heat engine according to claim 4, wherein the switch comprises one of an electromechanical switch, electromechanical three-pole change-over switch (3PC), a solid state relay, and a semiconductor switch.

7. The ORC heat engine according claim 4 wherein the expander-generator comprises one of a scroll expander and a permanent magnet generator.

8. The ORC heat engine according to claim 4, wherein the driving means comprises one of an inverter and a motor and the switch having a clutch for connecting and disconnecting the motor from the expander-generator.

9. The ORC heat engine according to claim 8, wherein the inverter is configured to take power from a direct current bus and supply a 3-phase electrical current to the positive displacement expander-generator in order to drive the positive displacement expander-generator.

10. The ORC heat engine according to claim 9, wherein the inverter is switchable to act as a rectifier so that, when the positive displacement expander-generator is generating a 3-phase electrical current, the inverter acts as a rectifier to convert the 3-phase electrical current produced to a direct current (DC) for supply to a DC bus.

11. The ORC heat engine according to claim 8, wherein the first sensing means is configured to adjust the output of the inverter by adjusting the electrical current supplied to the inverter, and wherein the operating parameter of the inverter sensed by the second sensing means is the electrical current being supplied to the inverter.

12. The ORC heat engine according to claim 11, wherein the predetermined operating condition is met when the electrical current being supplied to the inverter is less than or equal to a predetermined threshold.

13. The ORC heat engine according to claim 4, further comprising a regenerator heat exchanger arranged to facilitate the exchange of heat between working fluid exiting the outlet of the positive displacement expander-generator and the working fluid entering the evaporator.

14. An electrical system comprising an ORC heat engine according to claim 1, and an electrical load arranged to be electrically coupled to the expander-generator when the switch is in the second state such that the electrical load can be powered by electrical power produced by the expander-generator.

15. A control system for controlling an ORC heat engine, comprising:

an inverter;

a switch being switchable between a first state and a second state;

sensing means coupled to the switch and configured to sense an operating condition of the ORC heat engine; and processing means coupled to the sensing means, the processing means being configured to switch the switch between the first and second states when a predetermined operating condition is met;

wherein in the first state the switch is electrically coupled to the inverter and in the second state the switch is not electrically coupled to the inverter, such that when the control system is connected to a heat engine that comprises a positive displacement expander-generator, the positive displacement expander-generator is drivable by the inverter when the switch is in the first state, and the positive displacement expander-generator is not drivable by the inverter when the switch, is in the second state; and wherein the predetermined operating condition is the thermodynamic flow through the positive displacement expander-generator being sufficient to keep the positive displacement expander-generator rotating once the positive displacement expander-generator is disconnected from the inverter and connected to an electrical load.

16. A method of controlling an ORC heat engine, comprising the steps of:

(i) providing an ORC heat engine according to claim 1 with the switch in the first state;

(ii) operating the driving means to drive the positive displacement expander-generator and thereby circulate working fluid around the working fluid circuit;

(iii) switching the switch from the first state to the second state so that the expander-generator is driven by the circulating working fluid and not the driving means, and generates electrical power, wherein the processing means automatically executes step (iii) when the predetermined operating condition is met.

17. The method according to claim 16, wherein the working fluid circuit of the ORC heat engine further comprises a pump for increasing the pressure of working fluid circulating around the working fluid circuit, and wherein the method further comprises the step of:

(iv) operating the pump to increase the pressure of the circulating working fluid, prior to step (iii).

18. The method according to claim 17, wherein the positive displacement expander-generator of the ORC heat engine comprises an expander and a generator each on a common shaft and the pump is coupled to the expander-generator on the common shaft, and wherein step (iv) is performed simultaneously with step (ii).

19. The method according to claim 16, wherein the sensing means comprises a first sensing means and a second sensing means, wherein the first sensing means senses the rotational speed of the positive displacement expander-generator and adjusts the output of the driving means such that a substantially fixed rotational speed of the expander-generator is maintained when the switch is in the first state, and the second sensing means senses an operating parameter of the driving means; and wherein the predetermined operating condition is met when the output of the driving means is less than or equal to a predetermined threshold.

20. The method according to claim 17, wherein the sensing means senses a pressure lift in the working fluid produced by the pump, and the predetermined operating condition is met when the sensed pressure lift is greater than or equal to a predetermined threshold.

21. The method according to claim 16, further comprising the step of connecting the expander-generator to an electrical load via the switch prior to executing step (iii), wherein subsequent to step (iii) electrical power generated by the expander-generator is supplied to the electrical load via the switch.

22. The method according to claim 16, wherein the driving means comprises an inverter.

* * * * *